US011183100B2

(12) United States Patent
Liu et al.

(10) Patent No.: US 11,183,100 B2
(45) Date of Patent: Nov. 23, 2021

(54) TIMING CONTROLLER CIRCUIT OF ELECTRONIC PAPER DISPLAY APPARATUS

(71) Applicant: E Ink Holdings Inc., Hsinchu (TW)

(72) Inventors: Shu-Cheng Liu, Hsinchu (TW); Pei-Lin Tien, Hsinchu (TW); Chi-Mao Hung, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 136 days.

(21) Appl. No.: 15/702,746

(22) Filed: Sep. 12, 2017

(65) Prior Publication Data

US 2018/0158392 A1 Jun. 7, 2018

(30) Foreign Application Priority Data

Dec. 2, 2016 (CN) ..... 201611094099.1

(51) Int. Cl.
*G09G 3/20* (2006.01)
*G09G 3/34* (2006.01)

(52) U.S. Cl.
CPC ..... *G09G 3/2007* (2013.01); *G09G 3/2044* (2013.01); *G09G 3/34* (2013.01); *G09G 2310/06* (2013.01); *G09G 2310/08* (2013.01); *G09G 2320/0271* (2013.01); *G09G 2320/0613* (2013.01); *G09G 2320/103* (2013.01); *G09G 2360/16* (2013.01)

(58) Field of Classification Search
None
See application file for complete search history.

(56) References Cited

U.S. PATENT DOCUMENTS

2004/0140972 A1* 7/2004 Hirota ..... G09G 3/20 345/204
2009/0083448 A1* 3/2009 Graine ..... G06F 3/01 710/8
2009/0219241 A1* 9/2009 Tamura ..... G09G 3/3614 345/89

(Continued)

FOREIGN PATENT DOCUMENTS

CN 101034532 9/2007
CN 102314834 1/2012

(Continued)

OTHER PUBLICATIONS

"Office Action of China Counterpart Application," dated May 7, 2019, p. 1-p. 7.

*Primary Examiner* — William Boddie
*Assistant Examiner* — Alecia D English
(74) *Attorney, Agent, or Firm* — JCIPRNET

(57) ABSTRACT

A timing controller circuit of an electronic paper display apparatus including an image processing circuit and a timing controller is provided. The image processing circuit receives an image signal and analyzes the image signal according to a signal component of the image signal, so as to determine a display mode of the electronic paper display apparatus. The image processing circuit selects a driving signal waveform according to the determined display mode. The timing controller is electrically connected to the image processing circuit. The timing controller outputs the selected driving signal waveform to drive an electronic paper display panel of the electronic paper display apparatus to display image frames.

9 Claims, 9 Drawing Sheets

(56) References Cited

U.S. PATENT DOCUMENTS

2011/0001767 A1* 1/2011 Kajiyama ..... G09G 3/3233 345/691
2011/0227961 A1* 9/2011 Kikuta ..... G09G 3/3225 345/690
2011/0285290 A1* 11/2011 Griffin ..... G06F 1/1656 315/76
2012/0038687 A1* 2/2012 Lin ..... G09G 3/344 345/690
2012/0120039 A1 5/2012 Su et al.
2012/0188272 A1 7/2012 Wang et al.
2013/0127760 A1* 5/2013 Song ..... G06F 3/03545 345/173
2013/0235055 A1 9/2013 Kim et al.
2013/0342590 A1 12/2013 Lee et al.
2014/0062980 A1 3/2014 Kuo et al.
2014/0071174 A1 3/2014 Kim et al.
2014/0078035 A1* 3/2014 Sato ..... G09G 3/2011 345/107
2014/0146066 A1* 5/2014 Kang ..... G09G 3/3225 345/545
2014/0146071 A1 5/2014 Kim et al.
2014/0198028 A1* 7/2014 Lee ..... G06F 1/1613 345/156
2015/0213627 A1 7/2015 Ahn et al.
2017/0040002 A1* 2/2017 Basson ..... G06F 21/84
2017/0124958 A1* 5/2017 Pyo ..... G09G 3/3233

FOREIGN PATENT DOCUMENTS

| | | |
|---|---|---|
| CN | 104081448 | 10/2014 |
| CN | 104252848 | 12/2014 |
| CN | 104978934 | 10/2015 |
| TW | 594112 | 6/2004 |
| TW | 200530996 | 9/2005 |
| TW | 201015517 | 4/2010 |
| TW | 201120863 | 6/2011 |

* cited by examiner

TIMING CONTROLLER CIRCUIT OF ELECTRONIC PAPER DISPLAY APPARATUS

CROSS-REFERENCE TO RELATED APPLICATION

This application claims the priority benefit of China application serial no. 201611094099.1, filed on Dec. 2, 2016. The entirety of the above-mentioned patent application is hereby incorporated by reference herein and made a part of this specification.

BACKGROUND OF THE INVENTION

1. Field of the Invention

The invention relates to a timing controller circuit, and more particularly, to a timing controller circuit of an electronic paper display apparatus.

2. Description of Related Art

In recent years, as display apparatuses gradually developed to be lighter and thinner, electronic paper display apparatuses now become one display apparatus that meets public demands. With advantages of thinness and lightness, durability and low power consumption for energy saving and environmental protection, electronic paper display apparatuses have been widely applied in electronic readers (e.g., electronic books, electronic newspaper) or other electronic component (e.g., electronic tags) on the market.

In the prior art, an external microcontroller unit (MCU), a system-on-a-chip (SOC) or other embedded systems are generally used as a system application control in a related application of an electronic paper display apparatus. The system application control can control a display function of the electronic paper display panel by controlling a timing controller circuit of the electronic paper display apparatus. Accordingly, in such related application, a display control and a display mode of the electronic paper display panel will both be selected by the system application control. However, a development time for the electronic paper display apparatus can be extended if the display control and the display mode are both selected by the system application control, and the timing controller circuit can have difficulties in adjusting the display quality.

SUMMARY OF THE INVENTION

The invention is directed to a timing controller circuit of an electronic paper display apparatus, which is configured to drive an electronic paper display panel to provide favorable display quality.

A timing controller circuit of an electronic paper display apparatus according to the invention includes an image processing circuit and a timing controller. The image processing circuit receives an image signal and analyzes the image signal according to a signal component of the image signal, so as to determine a display mode of the electronic paper display apparatus. The image processing circuit selects a driving signal waveform according to the determined display mode. The timing controller is electrically connected to the image processing circuit. The timing controller outputs the selected driving signal waveform to drive an electronic paper display panel of the electronic paper display apparatus to display image frames.

In an embodiment of the invention, the signal component is a grayscale signal selected from the image signal.

In an embodiment of the invention, the display mode includes a static display mode and a dynamic display mode.

In an embodiment of the invention, the image signal includes a previous image frame and a current image frame. The image processing circuit determines whether the display mode is the static display mode or the dynamic display mode according to a difference between the previous image frame and the current image frame.

In an embodiment of the invention, the image processing circuit determines that the display mode is the dynamic display mode if the difference between the previous image frame and the current image frame is continuous.

In an embodiment of the invention, the image processing circuit determines that the display mode is the static display mode if the difference between the previous image frame and the current image frame is non-continuous.

In an embodiment of the invention, the image processing circuit further analyzes the image signal according to the signal component of the image signal so as to determine a type of the image frame, and selects the driving signal waveform according to the determined type of the image frame.

In an embodiment of the invention, the type of the image frame includes a black and white image frame and a grayscale image frame.

In an embodiment of the invention, the image processing circuit and the timing controller are disposed on the same chip.

In an embodiment of the invention, the electronic paper display apparatus includes a driving circuit for driving the electronic paper display panel to display the image frame. The driving circuit is disposed on the electronic paper display panel. The timing controller outputs the selected driving signal waveform to the driving circuit. The driving circuit drives the electronic paper display panel to display the image frame according to the selected driving signal waveform.

Based on the above, as described in the exemplary embodiments of the invention, the image processing circuit selects the driving signal waveform according to the determined display mode and provide the driving signal waveform to the timing controller in order to drive the electronic paper display panel so the electronic paper display panel provides favorable display quality.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
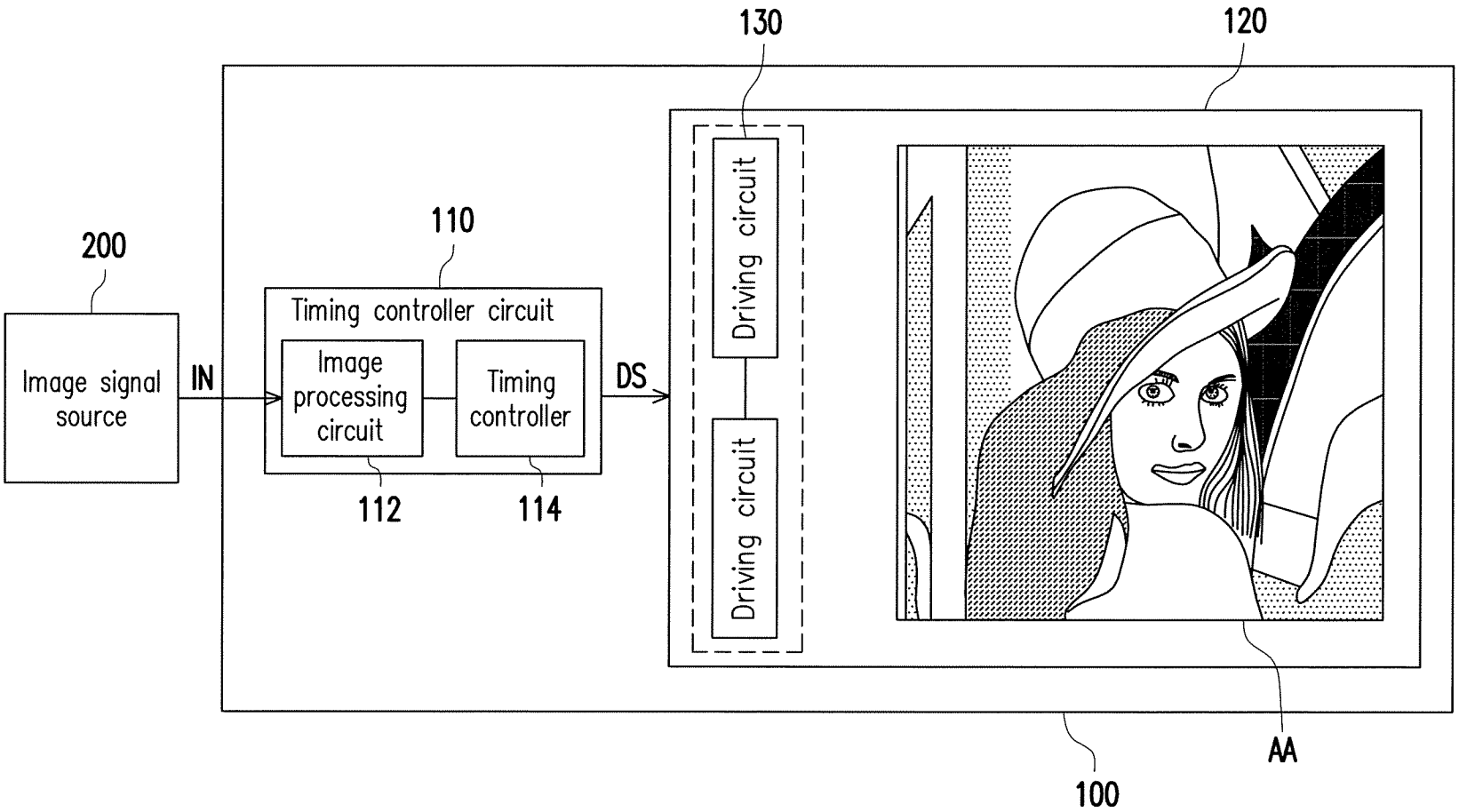
FIG. 1 illustrates a schematic diagram of a timing controller circuit of an electronic paper display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Embodiments are provided below to describe the invention in detail, though the invention is not limited to the provided embodiments, and the provided embodiments may be suitably combined. The term "coupling/coupled" used in this specification (including claims) of the present application may refer to any direct or indirect connection means. For example, "a first device is coupled to a second device" may be interpreted as "the first device is directly connected to the second device" or "the first device is indirectly connected to the second device through other devices or connection means." In addition, the term "signal" may refer to a current, a voltage, a charge, a temperature, data, electromagnetic wave or any one or multiple signals.

FIG. 1 illustrates a schematic diagram of a timing controller circuit of an electronic paper display apparatus according to an embodiment of the invention. Referring to FIG. 1, an electronic paper display apparatus 100 of the present embodiment includes a timing controller circuit 110, an electronic paper display panel 120 and a driving circuit 130. In the present embodiment, the driving circuit 130 is, for example, disposed on the electronic paper display panel 120, and configured to drive the electronic paper display panel 120 to display an image frame on a display area AA. In an embodiment, the driving circuit 130 may also be disposed outside independent from the electronic paper display panel 120.

In the present embodiment, an image signal source 200 is configured to output an image signal IN to the timing controller circuit 110. The image signal source 200 is, for example, a continuous image signal source which includes, but not limited to, a video interface such as High Definition Multimedia Interface (HDMI), Digital Visual Interface (DVI), Video Graphics Array (VGA) interface or other embedded systems for outputting image signals to a liquid crystal display apparatus.

In other words, in the present embodiment, the timing controller circuit 110 of the electronic paper display panel 120 receives the image signal IN to be outputted to the liquid crystal display apparatus by using the video interface of the image signal source 200 in the related art. That is to say, in the present embodiment, the video interface of the image signal source 200 is used as an input interface so the timing controller circuit 110 of the electronic paper display apparatus 100 adaptively controls and selects a display mode to provide favorable display quality.

Specifically, the timing controller circuit 110 of the present embodiment includes an image processing circuit 112 and a timing controller 114. The image processing circuit 112 and the timing controller 114 are, for example, disposed on the same chip so the timing controller circuit 110 adaptively controls and selects the display mode to provide favorable display quality. Unlike the prior art, the display control and the display mode of the electronic paper display apparatus are both selected by the timing controller circuit 110.

In the present embodiment, the image processing circuit 112 is configured to receive the image signal IN and analyze the image signal IN according to a signal component of the image signal IN, so as to determine whether the display mode of the electronic paper display apparatus is a static display mode or a dynamic display mode. The image processing circuit 112 selects a driving signal waveform DS (e.g., those shown in FIG. 11, FIG. 12 and FIG. 13) according to the determined display mode. In an embodiment, the signal component includes, for example, image resolution, image brightness, image spectrum distribution, image discrepancy, image relevancy, image color depth, image refresh rate, image grayscale distribution or other similar image characteristics. In the present embodiment, the signal component of the image signal IN is a grayscale signal selected from the image signal IN.

In the present embodiment, the timing controller 114 is electrically connected to the image processing circuit 112. The timing controller 114 outputs the driving signal waveform DS selected by the image processing circuit 112 to the driving circuit 130 so as to drive the electronic paper display panel 120 of the electronic paper display apparatus 100 to display the image frame. Accordingly, in the present embodiment, the driving circuit 130 drives the electronic paper display panel 120 to display the image frame on the display area AA according to the driving signal waveform DS selected by the image processing circuit 112.

Figure 2:
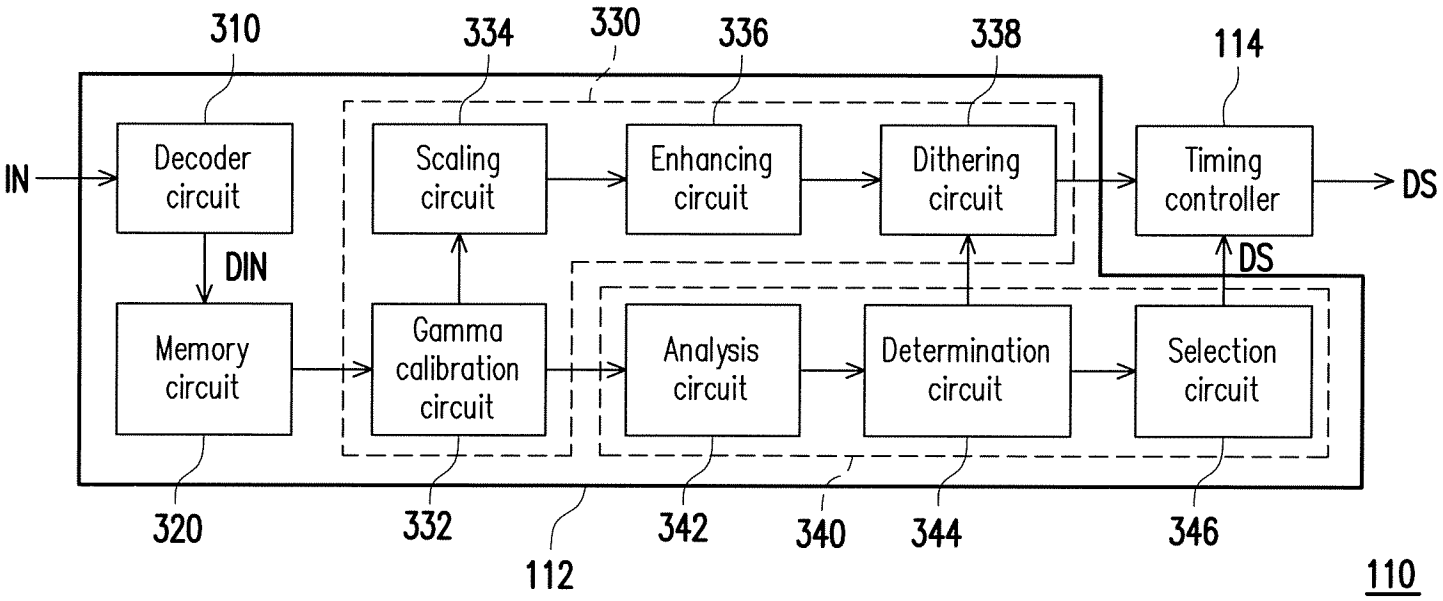
FIG. 2 illustrates a schematic diagram of an image processing circuit according to the embodiment of FIG. 1.

FIG. 2 illustrates a schematic diagram of an image processing circuit according to the embodiment of FIG. 1. Referring to FIG. 2, the image processing circuit 112 of the present embodiment includes, for example, a decoder circuit 310, a memory circuit 320, a first circuitry block 330 and a second circuitry block 340. In the present embodiment, the first circuitry block 330 includes a gamma calibration circuit 332, a scaling circuit 334, an enhancing circuit 336 and a dithering circuit 338. The second circuitry block 340 includes an analysis circuit 342, a determination circuit 344 and a selection circuit 346.

In the present embodiment, after the image signal IN is inputted to the image processing circuit 112, the decoder circuit 310 decodes the image signal IN so as to output a digital image signal DIN and store the digital image signal DIN to the memory circuit 320. The digital image signal DIN outputted by the decoder circuit 310 includes, for example, the grayscale signal. For instance, after decoding, the decoder circuit 310 outputs the image signal in YCbCr format, which is used in an image continuous processing in the first circuitry block 330 and the second circuitry block 340. In the present embodiment, the Y value includes, for example, the grayscale signal served as image data. The grayscale signal is processed in the first circuitry block 330 using a gamma correction. In the present embodiment, the image signal IN is, for example, continuously inputted to the timing controller circuit 110. The timing controller 114 sets a sampling frequency for image frames (e.g., sampling once per 200 milliseconds). However, the sampling frequency is not particularly limited by the invention.

In the present embodiment, the first circuitry block 330 reads the grayscale signal from the memory circuit 320, and sequentially executes image processing operations including a gamma correction operation, a resealing operation, a CR/edge enhance operation and a dithering process by using the gamma calibration circuit 332, the scaling circuit 334, the enhancing circuit 336 and the dithering circuit 338. Then, the first circuitry block 330 outputs the image data to the timing controller 114 so as to drive the electronic paper display panel 120 to display the image frame.

In the present embodiment, the gamma correction operation, the resealing operation, the CR/edge enhance operation and the dithering process may be implemented by using steps in respectively one of the gamma correction operation, the resealing operation, the CR/edge enhance operation and the dithering process in the field, which are not particularly limited by the invention.

In the present embodiment, the analysis circuit 342 of the second circuitry block 340 analyzes the image signal IN according to the grayscale signal, for example. The determination circuit 344 determines whether the display mode of the electronic paper display apparatus 100 is the static display mode or the dynamic display mode and determines a type of the image frame according to an analysis result of the analysis circuit 342. Next, the selection circuit 346 selects the suitable driving signal waveform DS according to the display mode or the type of the image frame determined by the determination circuit 344.

Figure 3:
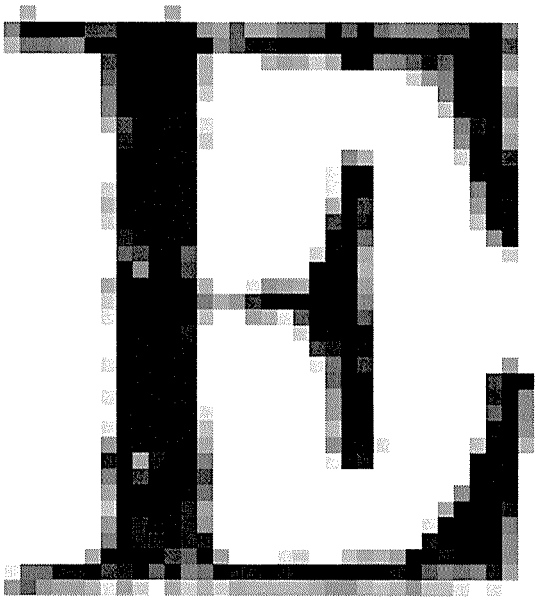
FIG. 3 illustrates a schematic diagram of one English alphabet in an image frame according to an embodiment of the invention.
Figure 4:
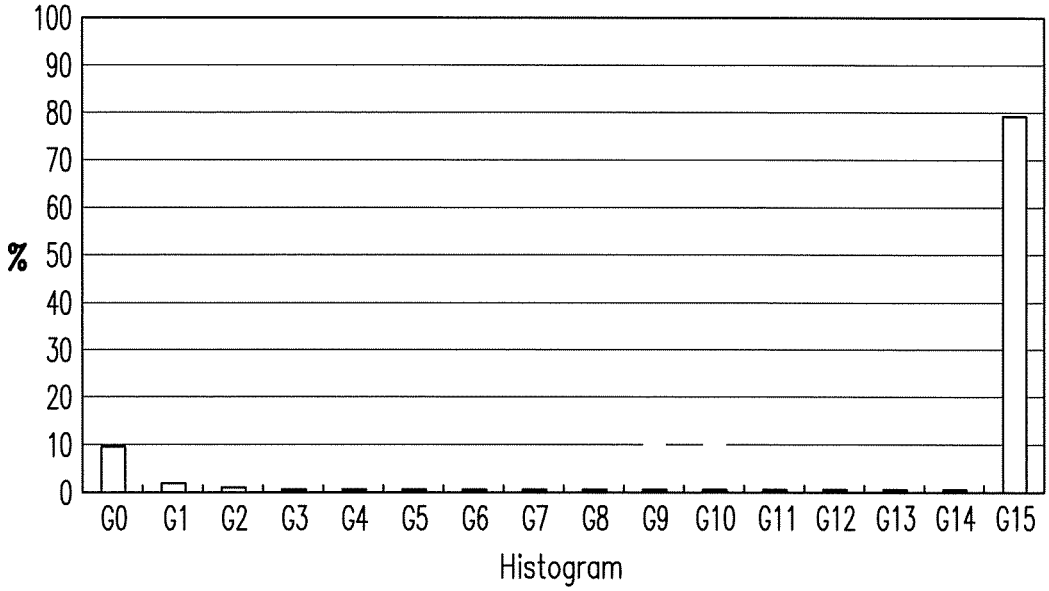
FIG. 4 illustrates a histogram of the image frame including the alphabet of FIG. 3, which indicates a grayscale distribution of said image frame overall.

In the present embodiment, the analysis circuit 342 analyzes a grayscale distribution in the image frame by using, for example, a histogram shown in FIG. 4, FIG. 6, FIG. 8 or FIG. 10. For instance, FIG. 3 illustrates a schematic diagram of one English alphabet in an image frame according to an embodiment of the invention. FIG. 4 illustrates a histogram of the image frame including the alphabet of FIG. 3, which indicates a grayscale distribution of said image frame overall. In the present embodiment, the image frame displayed by the display area AA is, for example, an article or a text paragraph, in which alphabets are displayed similar to the alphabet depicted in FIG. 3 with the grayscale distribution mainly in back. Therefore, in the histogram depicted in FIG. 4, the proportion occupied by black grayscale value G15 is between 70% and 80%, the proportion occupied by white grayscale value G0 is close to 10%, and the proportion occupied by each of gray grayscale values G1 to G14 is less than 5%. In this example, according to the analysis result of the analysis circuit 342 for the image frame including the alphabet of FIG. 3, the determination circuit 344 determines that the image frame is a black and white image frame, for example.

Figure 5:
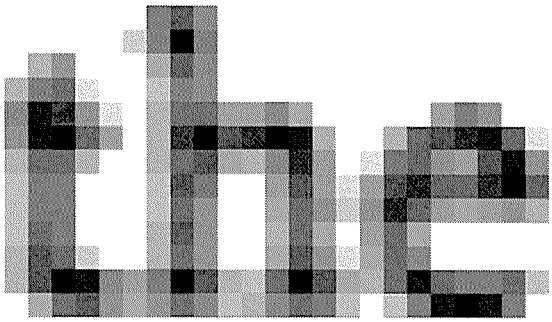
FIG. 5 illustrates a schematic diagram of one English word in an image frame according to another embodiment of the invention.
Figure 6:
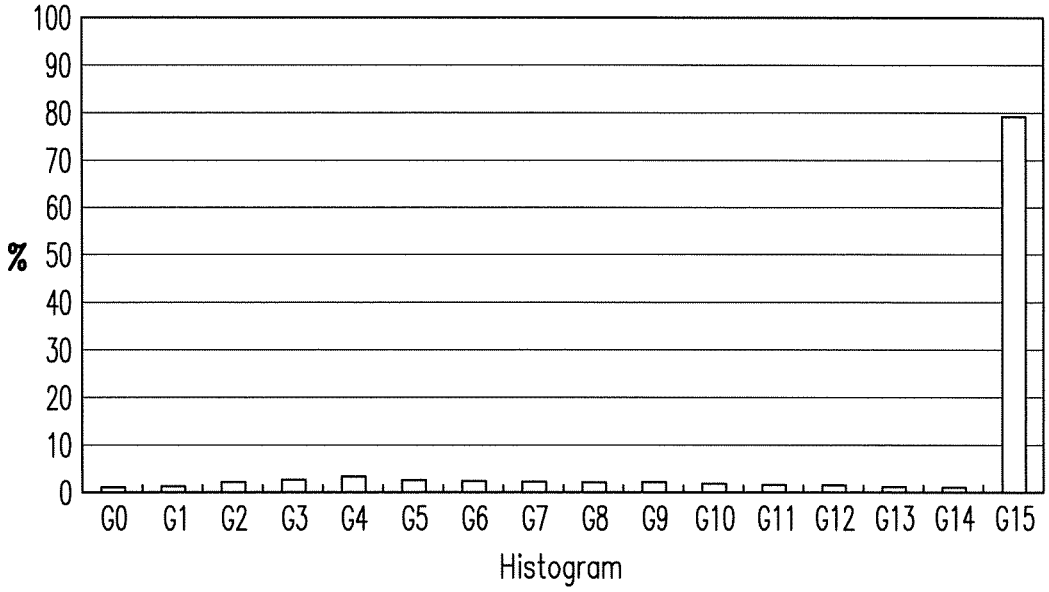
FIG. 6 illustrates a histogram of the image frame including the word of FIG. 5, which indicates a grayscale distribution of said image frame overall.

FIG. 5 illustrates a schematic diagram of one English word in an image frame according to another embodiment of the invention. FIG. 6 illustrates a histogram of the image frame including the word of FIG. 5, which indicates a grayscale distribution of said image frame overall. In the present embodiment, the image frame displayed by the display area AA is, for example, an article or a text paragraph, in which words are displayed similar to the word depicted in FIG. 5 with the grayscale distribution mainly in back. Therefore, in the histogram depicted in FIG. 6, the proportion occupied by black grayscale value G15 is between 70% and 80%, and the proportion occupied by each one of white grayscale value G0 and gray grayscale values G1 to G14 is less than 5%. In this example, according to the analysis result of the analysis circuit 342 for the image frame including the word of FIG. 5, the determination circuit 344 determines that the image frame is a black and white image frame, for example.

Figure 7:
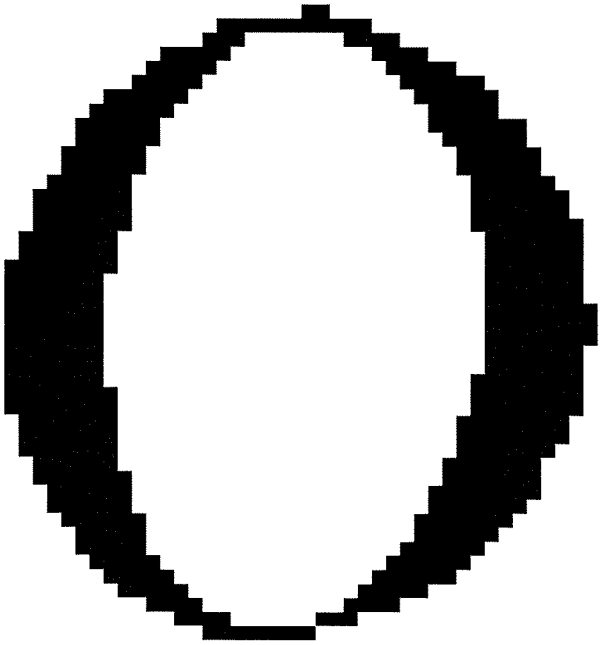
FIG. 7 illustrates a schematic diagram of one English alphabet in an image frame according to another embodiment of the invention.
Figure 8:
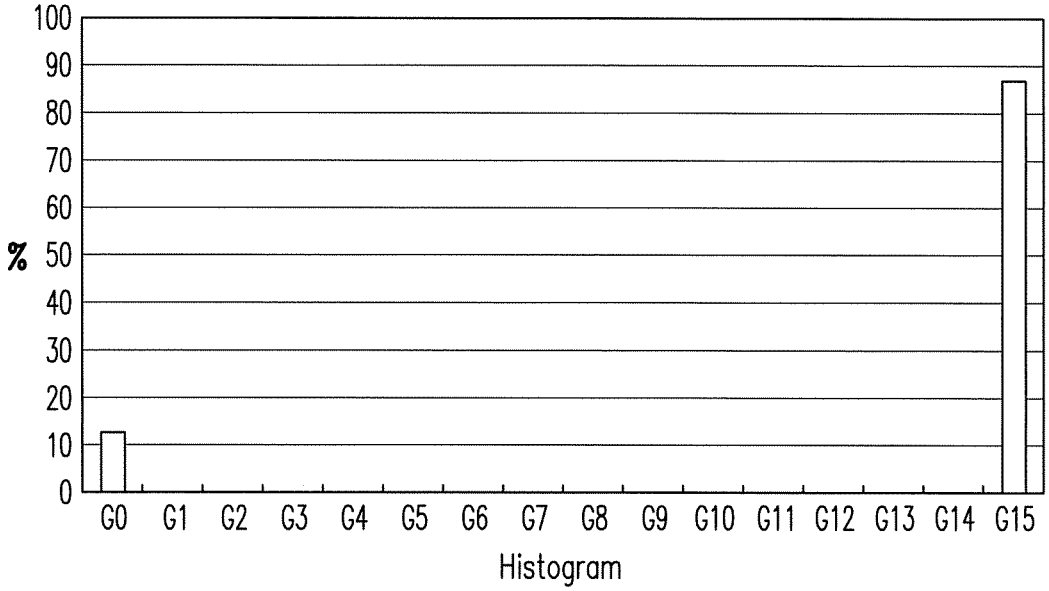
FIG. 8 illustrates a histogram of the image frame including the alphabet of FIG. 7, which indicates a grayscale distribution of said image frame overall.

FIG. 7 illustrates a schematic diagram of one English alphabet in an image frame according to another embodiment of the invention. FIG. 8 illustrates a histogram of the image frame including the alphabet of FIG. 7, which indicates a grayscale distribution of said image frame overall. In the present embodiment, the image frame displayed by the display area AA is, for example, an article or a text paragraph, in which alphabets are displayed similar to the alphabet depicted in FIG. 7 with the grayscale distribution mainly in back. Therefore, in the histogram depicted in FIG. 8, the proportion occupied by black grayscale value G15 is between 80% and 90%, the proportion occupied by white grayscale value G0 is between 10% and 20%, and the proportion occupied by each of gray grayscale values G1 to G14 is almost 0%. In this example, according to the analysis result of the analysis circuit 342 for the image frame including the alphabet of FIG. 7, the determination circuit 344 determines that the image frame is a black and white image frame, for example.

Figure 9:
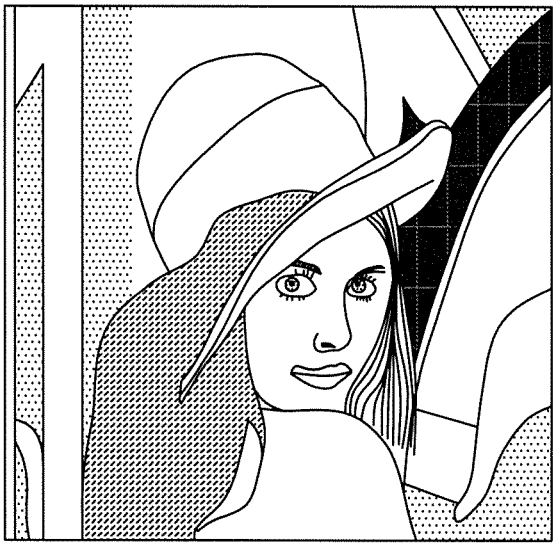
FIG. 9 illustrates a schematic diagram of an image frame according to another embodiment of the invention.
Figure 10:
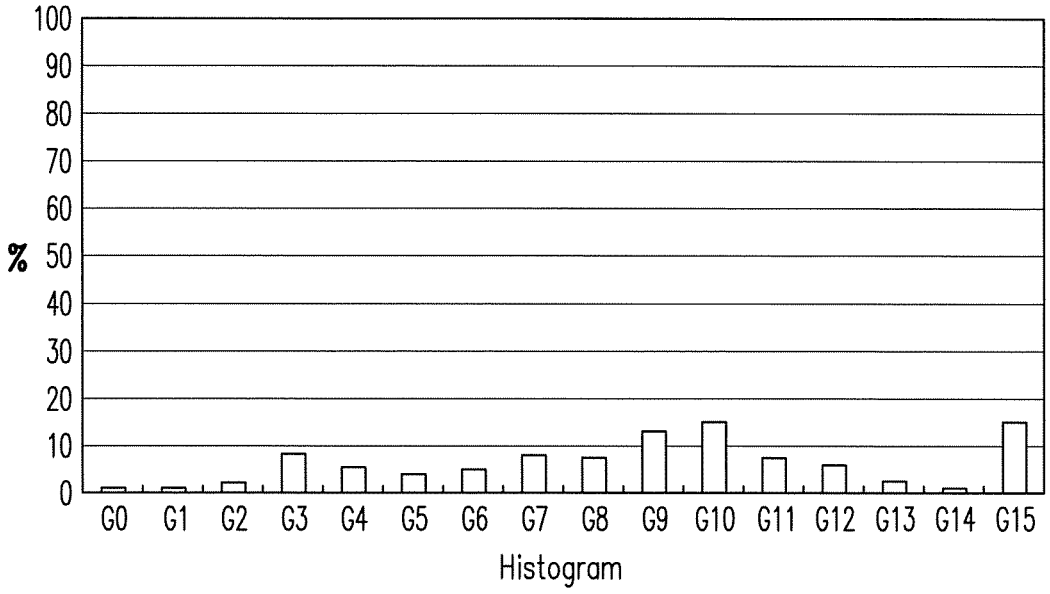
FIG. 10 illustrates a histogram of the image frame of FIG. 9, which indicates a grayscale distribution of said image frame overall.

FIG. 9 illustrates a schematic diagram of an image frame according to another embodiment of the invention. FIG. 10 illustrates a histogram of the image frame of FIG. 9, which indicates a grayscale distribution of said image frame overall. In the present embodiment, the image frame displayed by the display area AA is, for example, a landscape image or a portrait image with the grayscale distribution substantially uniform. However, content of the image is not particularly limited by the invention. As such, in the histogram of the image frame displayed by the image area AA, condition of the grayscale distribution is as shown by FIG. 10. In this example, according to the analysis result of the analysis circuit 342 for the image frame of FIG. 9, the determination circuit 344 determines that the image frame is a grayscale image frame, for example.

In this way, the determination circuit 344 determines the type of the image frame according to the analysis result of the analysis circuit 342. Next, the selection circuit 346 selects the suitable driving signal waveform DS according to whether the type of the image frame is the black and white image frame or the grayscale image frame as determined by the determination circuit 344.

Figure 11:
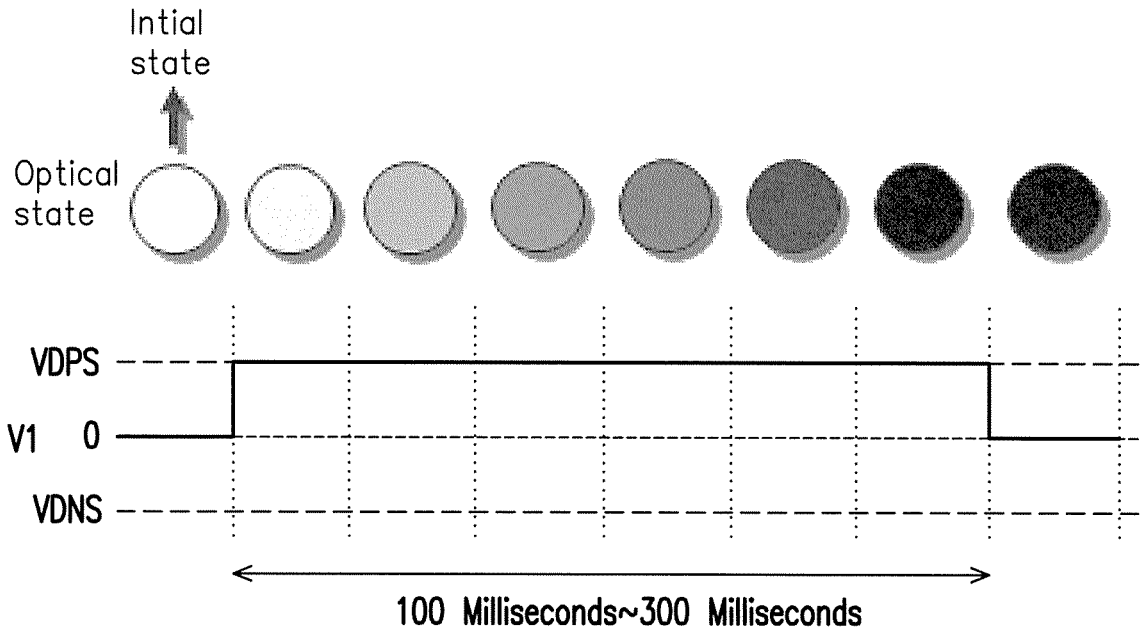
FIG. 11, FIG. 12 and FIG. 13 illustrate driving signal waveforms according to different embodiments of the invention.
Figure 12:
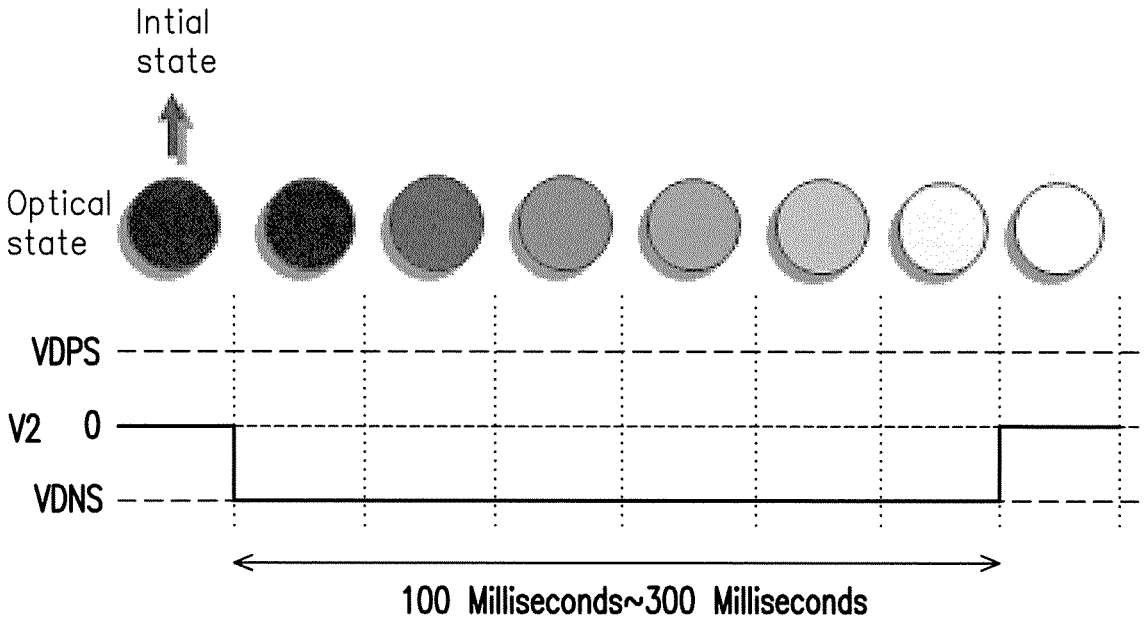
Figure 13:
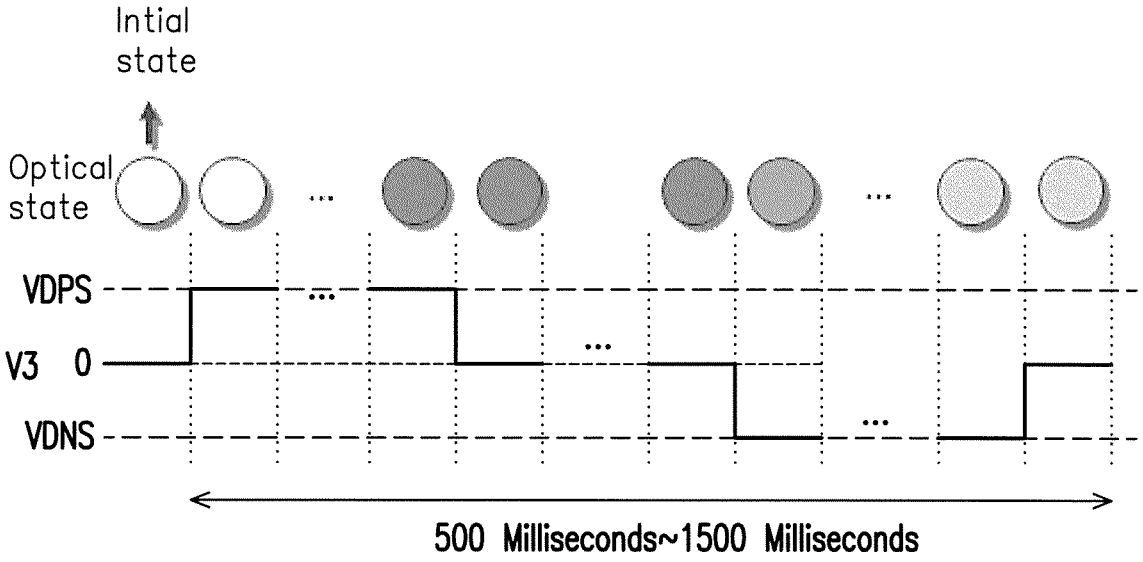

FIG. 11, FIG. 12 and FIG. 13 illustrate driving signal waveforms according to different embodiments of the invention. Referring to FIG. 11 to FIG. 13, a driving signal waveform V1 depicted in FIG. 11 is to drive optical state of particle in the electronic paper display panel 120 driven from initial state of white to display state of black, for example. A driving signal waveform V2 depicted in FIG. 12 is to drive optical state of particle in the electronic paper display panel 120 from initial state of black to display state of white, for example. A driving signal waveform V3 depicted in FIG. 13 is drive optical state of particle in the electronic paper display panel 120 from initial state of white to display state of different gray colors, for example. In FIG. 11 to FIG. 13, voltages VDPS and VDS are respectively high level and low level of each of the driving signal waveforms V1, V2 and V3. Further, drive time of each the driving signal waveforms V1 and V2 is between 100 milliseconds and 300 milliseconds, which is relatively shorter than drive time of the driving signal waveform V3 ranged between 500 milliseconds and 1500 milliseconds. In FIG. 11 to FIG. 13, time lengths and states of the driving signal waveforms V1, V2 and V3 are illustrative examples, and the invention is not limited thereto.

Therefore, in the exemplary embodiments of the invention, if the determination circuit 344 determines that the image frame is the black and white image frame, the selection circuit 346 selects the driving signal waveforms V1 and V2 to be outputted to the timing controller 114, for example. If the determination circuit 344 determines that the image frame is the grayscale image frame, the selection circuit 346 selects the driving signal waveforms V1, V2 and V3 to be outputted to the timing controller 114, for example.

In the present embodiment, the determination circuit 344 further determines whether the display mode of the electronic paper display apparatus 100 is the static display mode or the dynamic display mode according to the analysis result of the analysis circuit 342. Next, the selection circuit 346 selects the suitable driving signal waveform DS according to the display mode determined by the determination circuit 344.

Figure 14:
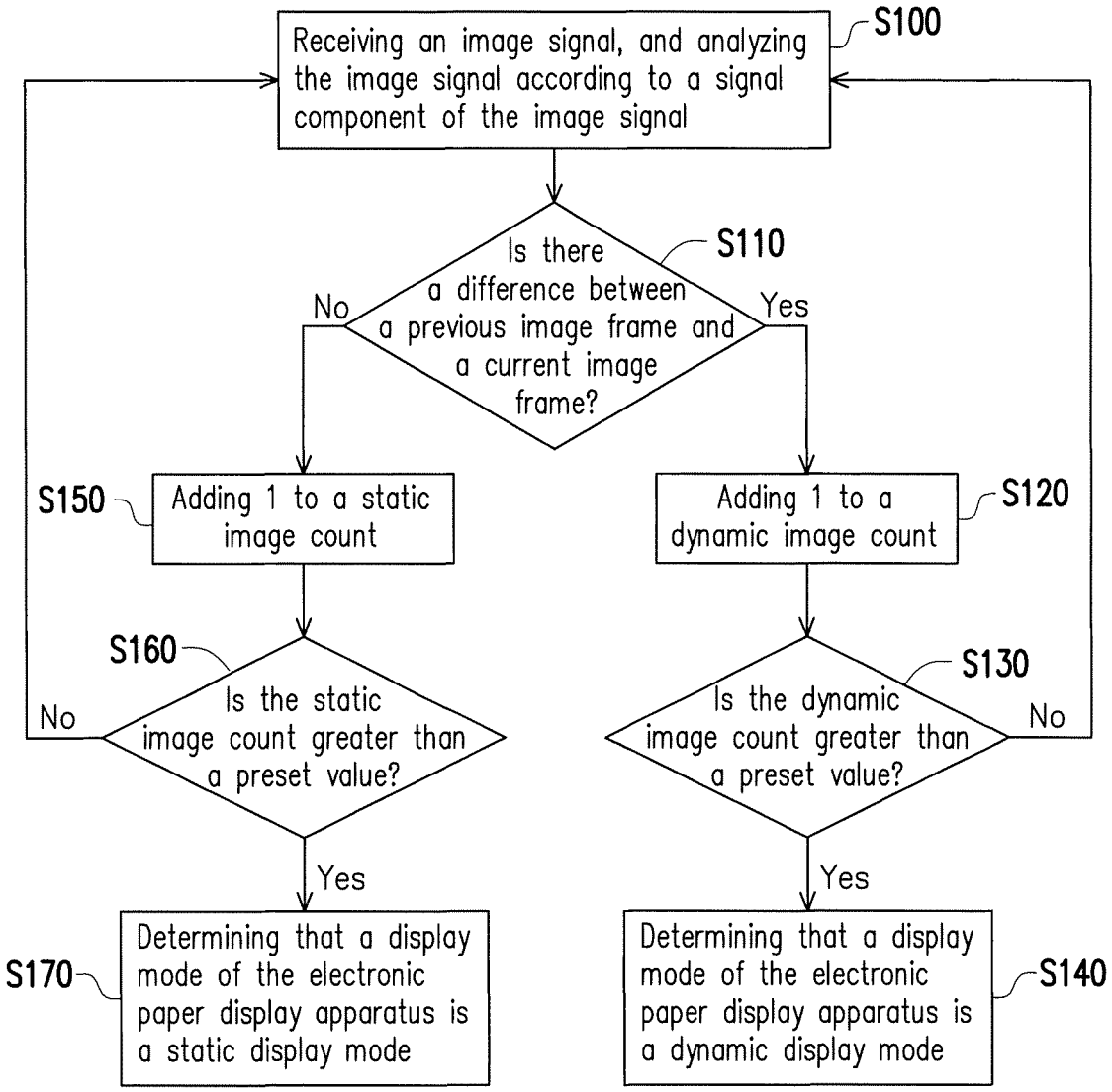
FIG. 14 illustrates a schematic diagram of a mode determination method according to an embodiment of the invention.

For instance, FIG. 14 illustrates a schematic diagram of a mode determination method according to an embodiment of the invention. Referring to FIG. 2 and FIG. 14, the mode determination method of the present embodiment is at least suitable for the timing controller circuit 110 of FIG. 2. Taking the timing controller circuit 110 of FIG. 2 for example, in step S100, the analysis circuit 342 receives an image signal, and analyzes the image signal according to a signal component of the image signal. For example, the analysis circuit 342 analyzes the grayscale distribution in the image frame by using the histogram shown in FIG. 4, FIG. 6, FIG. 8 or FIG. 10. In the present embodiment, the image signal includes a previous image frame and a current image frame. Accordingly, in step S100, an analysis result of the analysis circuit 342 includes grayscale distributions of the previous image frame and the current image frame. In step S110, the determination circuit 344 determines whether there is a difference between the previous image frame and the current image frame (e.g., a difference between gray levels) according to the analysis result of the analysis circuit 342. The invention is not intended to limit the difference only to be the difference between gray levels, the analysis circuit 342 may also analyze resolution, image brightness or other similar image characteristics for the previous image frame and the current image frame so the determination circuit 344 determines the difference therefrom.

If it is determined that the difference is present, the mode determination method proceeds to step S120. In step S120, if the difference between the previous image frame and the current image frame is present, the determination circuit 344 adds 1 to a dynamic image count. Then, in step S130, the determination circuit 344 determines whether the dynamic image count is greater than a preset value. If the dynamic image count is greater than the preset value, it means that the difference between the previous image frame and the current image frame is continuous. That is to say, there are differences continuously happening throughout multiple image frames, and the number of different image frames is determined by the preset value. When the difference is continuous, the mode determination method proceeds to step S140, in which the determination circuit 344 determines that a display mode of the electronic paper display apparatus 100 is a dynamic display mode. If the dynamic image count is not greater than the preset value, the mode determination method returns back to step S100, in which the grayscale distribution in the image frame is analyzed once again.

If it is determined that the difference is not present, the mode determination method proceeds to step S150. In step S150, if the difference between the previous image frame and the current image frame is not present, the determination circuit 344 adds 1 to a static image count. Then, in step S160, the determination circuit 344 determines whether the static image count is greater than a preset value. If the static image count is greater than the preset value, it means that the difference between the previous image frame and the current image frame is non-continuous. That is to say, there are no continuous differences happening throughout multiple image frames, and the number of identical image frames is determined by the preset value. When the difference is non-continuous, the mode determination method proceeds to step S170, in which the determination circuit 344 determines that a display mode of the electronic paper display apparatus 100 is a static display mode. If the static image count is not greater than the preset value, the mode determination method returns back to step S100, in which the grayscale distribution in the image frame is analyzed once again.

In addition, enough teaching, suggestion, and description regarding the mode determination method in the present embodiment of the invention may be obtained from the above embodiments depicted in FIG. 1 to FIG. 13, and thus related description thereof is not repeated hereinafter.

Accordingly, by using the mode determination method of FIG. 14, the determination circuit 344 determines whether the display mode of the electronic paper display apparatus 100 is the static display mode or the dynamic display mode according to the analysis result of the analysis circuit 342. Next, the selection circuit 346 selects the suitable driving signal waveform DS according to the display mode determined by the determination circuit 344. For instance, in the dynamic display mode, when the image frame continuously changes for a period of time, the selection circuit 346 drives the electronic paper display panel 120 to display the dynamic display image by, for example, controlling the number of gray levels in the dithering process and selecting the driving signal waveform with shorter drive time. In the static display mode, when image frame remains unchanged for a period of time, the selection circuit 346 drives the electronic paper display panel 120 to display the static display image by, for example, controlling the number of gray levels in the dithering process and selecting the driving signal waveform with longer drive time. The static display mode generates gray levels but will flash, whereas the dynamic display mode only generates black level and white level but will not flash. Therefore, the electronic paper display panel provides favorable display quality by displaying the image frame according to aforesaid method for selecting the dynamic display mode or the static display mode.

In the embodiments of FIG. 1 and FIG. 2, each of the circuitry blocks may be implemented by any suitable circuit scheme in the field, which is not particularly limited by the invention. Enough teaching, suggestion, and description for detailed structure and implementation of the above may be obtained with reference to common knowledge in the related art, which is not repeated hereinafter.

In summary, as described in the exemplary embodiments of the invention, the image processing circuit selects the driving signal waveform according to the determined display mode or the type of the image frame and provide the driving signal waveform to the timing controller in order to drive the electronic paper display panel so the electronic paper display panel provides favorable display quality. Unlike the prior art, the display control and the display mode of the electronic paper display apparatus are both selected by the timing controller circuit in the exemplary embodiments of the invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A timing controller circuit of an electronic paper display apparatus, comprising:

an image processing circuit, configured to receive an image signal, analyze the image signal according to a signal component of the image signal so as to determine a display mode of the electronic paper display apparatus, and select a driving signal waveform according to a determined display mode; and a timing controller, electrically connected to the image processing circuit to receive a selected driving signal waveform provided by the image processing circuit, and configured to output the selected driving signal waveform to drive an electronic paper display panel of the electronic paper display apparatus to display an image frame, wherein the display mode comprises a static display mode and a dynamic display mode, wherein in the dynamic display mode, the image processing circuit performs a first dithering operation and selects a first driving signal waveform with a shorter drive time based on a first number of gray levels of a plurality of gray levels in the first dithering operation, wherein in the static display mode, the image processing circuit performs a second dithering operation and selects a second driving signal waveform with a longer drive time based on a second number of gray levels of the plurality of gray levels in the second dithering operation, wherein the dynamic display mode only generates a black level which is the darkest of the plurality of gray levels and only generates a white level which is the lightest of the plurality gray levels, and wherein only the static display mode generates the plurality of gray levels which is capable of displaying different shades of gray, wherein the second driving signal waveform selected in the static display mode is generated by sequentially providing a fixed positive voltage maintaining in a first driving period, a fixed zero voltage maintaining in a second driving period, and a fixed negative voltage maintaining in a third driving period, wherein the first driving signal waveform selected in the dynamic display mode is generated by providing a fixed non-zero voltage maintaining in a fourth driving period, and a time length of the fourth driving period in the dynamic display mode is different from a time length of each of the first driving period, the second driving period and the third driving period in the static display mode.

2. The timing controller circuit of claim 1, wherein the signal component is a grayscale signal selected from image signal.

3. The timing controller circuit of claim 1, wherein the image signal comprises a previous image frame and a current image frame, and the image processing circuit determines whether the display mode is the static display mode or the dynamic display mode according to a difference between the previous image frame and the current image frame.

4. The timing controller circuit of claim 3, wherein the image processing circuit determines that the display mode is the dynamic display mode if the difference between the previous image frame and the current image frame is continuous.

5. The timing controller circuit of claim 3, wherein the image processing circuit determines that the display mode is the static display mode if the difference between the previous image frame and the current image frame is non-continuous.

6. The timing controller circuit of claim 1, wherein the image processing circuit further analyzes the image signal according to the signal component of the image signal so as to determine a type of the image frame, and selects the driving signal waveform according to the determined type of the image frame.

7. The timing controller circuit of claim 6, wherein the type of the image frame comprises a black and white image frame and a grayscale image frame.

8. The timing controller circuit of claim 1, wherein the image processing circuit and the timing controller are disposed on the same chip.

9. The timing controller circuit of claim 1, wherein the electronic paper display apparatus comprises a driving circuit for driving the electronic paper display panel to display the image frame, the driving circuit is disposed on the electronic paper display panel, the timing controller outputs the selected driving signal waveform to the driving circuit, and the driving circuit drives the electronic paper display panel to display the image frame according to the selected driving signal waveform.

* * * * *